US007899344B2

(12) United States Patent
Mase

(10) Patent No.: US 7,899,344 B2
(45) Date of Patent: Mar. 1, 2011

(54) IMAGE FORMING APPARATUS

(75) Inventor: Soichiro Mase, Handa (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 431 days.

(21) Appl. No.: 12/025,895

(22) Filed: Feb. 5, 2008

(65) Prior Publication Data

US 2008/0205915 A1 Aug. 28, 2008

(30) Foreign Application Priority Data

Feb. 27, 2007 (JP) ..... 2007-047472

(51) Int. Cl.
*G03G 15/08* (2006.01)
*G03G 21/16* (2006.01)
*G03G 15/04* (2006.01)

(52) U.S. Cl. ..... 399/27; 399/111; 399/119; 399/255; 399/258; 399/262

(58) Field of Classification Search ..... 399/27, 399/30, 61, 62, 149, 245, 258, 262, 263
See application file for complete search history.

(56) References Cited

U.S. PATENT DOCUMENTS 6,256,471 B1 7/2001 Sato et al.
6,501,933 B2 * 12/2002 Ishii ..... 399/254
6,721,525 B2 * 4/2004 Wang et al. ..... 399/258
2007/0122203 A1 * 5/2007 Sugimoto et al. ..... 399/254
2007/0189811 A1 * 8/2007 Sato ..... 399/254

FOREIGN PATENT DOCUMENTS

JP 11-282240 10/1999
JP 2000-275948 10/2000

* cited by examiner

*Primary Examiner*—David M Gray
*Assistant Examiner*—Francis Gray
(74) *Attorney, Agent, or Firm*—Banner & Witcoff, Ltd.

(57) ABSTRACT

An image forming apparatus includes a first cabinet, a toner carrier, an image carrier, a second cabinet disposed adjacent to the first cabinet, a toner amount detector and an empty decision unit. An inside of the first cabinet is communicated to an inside of the second cabinet through a plurality of openings. A spacing between one outer edge of one opening provided in one end side and another outer edge in a direction opposite to the longitudinal direction of another opening provided in another end side has a width not less than a width of an image forming region. The empty decision unit decides that a remaining state of a suspension polymerization toner in the second cabinet is the empty state before the amount of suspension polymerization toner in the second cabinet becomes smaller than the amount of suspension polymerization toner in the first cabinet.

7 Claims, 12 Drawing Sheets

IMAGE FORMING APPARATUS

CROSS-REFERENCE TO RELATED APPLICATIONS

This application claims priority from Japanese Patent Application No. 2007-047472 filed on Feb. 27, 2007, the entire subject matter of which is incorporated herein by reference.

TECHNICAL FIELD

Aspects of the present invention relates to an image forming apparatus.

BACKGROUND

There has been provided a laser printer employing a toner replenishment method, in which a toner cartridge for housing a toner is attached detachably from an inside of an apparatus body. The toner housed in the toner cartridge is supplied to the inside of a case for holding a developing roller or a photoconductive drum. When forming an image, the toner of the inside of the case is supplied to a surface of the photoconductive drum with the toner electrified positively or negatively by the developing roller. An electrostatic latent image formed on the surface of the photoconductive drum is developed by the toner and a toner image is carried on the surface of the photoconductive drum. The toner image is transferred to a sheet, and the image is formed on the sheet. In such a toner replenishment method, when the toner in the toner cartridge runs out, the toner cartridge is replaced with a new toner cartridge.

JP-A-11-282240 discloses a laser printer using suspension polymerization toner (for example, see JP-A-11-282240).

SUMMARY

Aspects of the invention provide an image forming apparatus capable of preventing occurrence of an image forming defect resulting from mixture of old and new suspension polymerization toners.

DETAILED DESCRIPTION

General Overview

Figure 1:
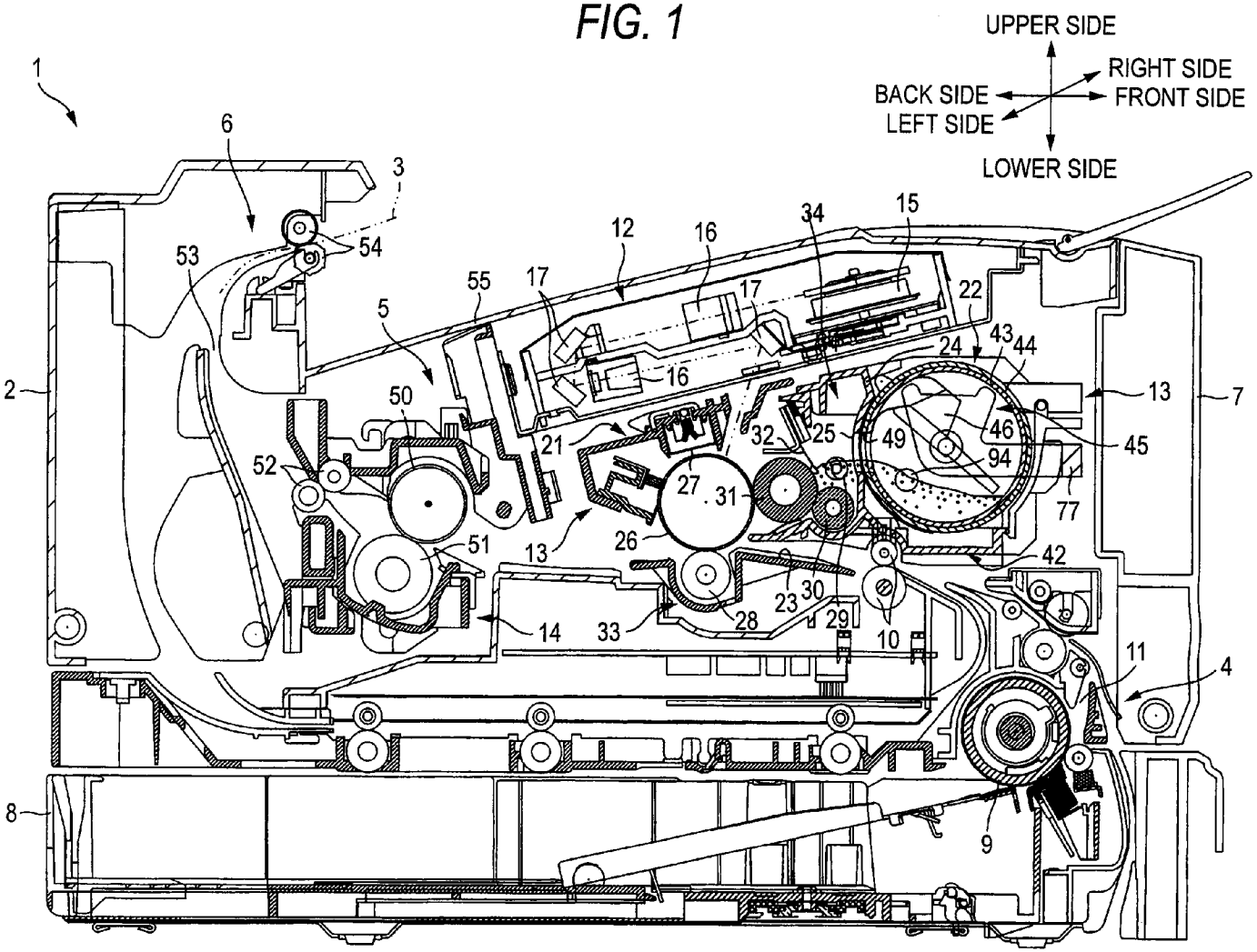
FIG. 1 is an exemplary side sectional view showing an image forming apparatus according to an aspect of the present invention.

According to an aspect of the invention, there is provided an image forming apparatus an image forming apparatus comprising: a first cabinet; a toner carrier that is supported in the first cabinet and carries suspension polymerization toner; an image carrier that forms an electrostatic latent image and carries a toner image obtained by imaging the electrostatic latent image by supply of the suspension polymerization toner from the toner carrier; a second cabinet that is disposed adjacently to the first cabinet in a horizontal direction orthogonal to a longitudinal direction of the toner carrier and houses the suspension polymerization toner; a toner amount detector that detects an amount of suspension polymerization toner in the second cabinet; and an empty decision unit that decides whether or not a remaining state of the suspension polymerization toner in the second cabinet is an empty state based on a detection result of the toner amount detector, wherein an inside of the first cabinet is communicated to an inside of the second cabinet through a plurality of openings, the plurality of openings including at least a supply port for supplying the suspension polymerization toner from the second cabinet to the first cabinet and a return port for returning the suspension polymerization toner from the first cabinet to the second cabinet, and the plurality of openings being arranged in the longitudinal direction of the toner carrier, wherein a spacing between one outer edge of one opening provided in one end side in a longitudinal direction of the plurality of openings and another outer edge in a direction opposite to a longitudinal direction of another opening provided in another end side in the longitudinal direction of the plurality of openings has a width not less than a width of an image forming region where the toner image is formed in the image carrier, and wherein the empty decision unit decides that the remaining state of the suspension polymerization toner in the second cabinet is the empty state before the amount of suspension polymerization toner in the second cabinet becomes smaller than the amount of suspension polymerization toner in the first cabinet.

Illustrative Aspects

Illustrative aspects of the invention will be described with reference to the drawings.

The suspension polymerization toner deteriorates as the image is formed. Due to the deterioration of the suspension polymerization toner, charging properties of the suspension polymerization toner deteriorate. Thus, when the toner cartridge is replaced with a new toner cartridge while the extremely deteriorating suspension polymerization toner remains inside the case, the deteriorated suspension polymerization toner is mixed with a new suspension polymerization toner in the new toner cartridge, and charged state of the mixed suspension polymerization toner becomes unequal. When such a mixed suspension polymerization toner is supplied to the surface of the photoconductive drum, an image forming defect (print defect) may be caused. Further, the deteriorating suspension polymerization toner and the new suspension polymerization toner may be aggregated due to a difference of the amount of electrification. Thus, the image forming defect may be caused.

Aspects of the invention provide an image forming apparatus capable of preventing occurrence of an image forming defect resulting from mixture of old and new suspension polymerization toners.

(Image Forming Apparatus)

FIG. 1 is an exemplary side sectional view showing an image forming apparatus according to an aspect of the present invention. In FIG. 1, the image forming apparatus is embodied in the form of a laser printer by way of an example. However, one of ordinary skill in the art will appreciate that the present inventive concept will apply equally to any apparatus which uses a toner for producing images on a recording medium.

An image forming apparatus 1 comprises a feeder unit 4 for feeding a sheet 3, an image forming unit 5 for forming an image on the sheet 3, a sheet discharge part 6 for discharging the sheet 3, and a body casing 2 for housing the feeder unit 4, the image forming unit 5, and the sheet discharge part 6. The body casing 2 is one example of an apparatus body.

(1) Body Casing

The body casing 2 has a substantially box shape. An opening is provided in a sidewall of one side of the body casing 2. A front cover 7 for opening and closing the opening is provided in the sidewall of one side of the casing 2.

Incidentally, in the following description, a side (right side in FIG. 1) where the front cover 7 is provided is referred to as a front side (front face side) and an opposite side (left side in FIG. 1) is referred to as a back side (rear side). Also, in the description that follows, references to upper, lower, left, and right sides of the image forming apparatus 1 are the upper, lower, left and right sides as viewed from the front side of the image forming apparatus 1. Also, a developing unit 13 and a toner cartridge 22 (both described in more detail below) are similarly described using directions in reference to the front side of the image forming apparatus 1.

(2) Feeder Unit

The feeder unit 4 includes a sheet feeding tray 8, a sheet feeding roller 9, a pair of resist rollers 10, and a sheet feeding path 11. An uppermost sheet 3 from an inside of the sheet feeding tray 8 is fed to the sheet feeding path 11 by rotation of the sheet feeding roller 9. The fed sheet 3 is conveyed to the resist rollers 10 through the sheet feeding path 11. The resist rollers 10 feed the sheet 3 toward the image forming unit 5 at proper timing.

(3) Image Forming Unit

The image forming unit 5 includes a scanner unit 12, the developing unit 13 and a fixing part 14. In FIG. 1, the developing unit 13 is embodied in the form of a process cartridge by way of an example. However, one of ordinary skill in the art will appreciate that the present inventive concept will apply equally to any unit which may be used for developing.

(3-1) Scanner Unit

The scanner unit 12 is arranged in an upper part of the inside of the body casing 2. The scanner unit 12 includes a laser light emitting unit (not shown), a polygon mirror 15, a lens 16 and a reflecting mirror 17. A laser beam based on data of an image to be formed on the sheet 3 is emitted from the scanner unit 12 and a surface of a photoconductive drum 26 described below is irradiated with the laser beam.

(3-2) Developing Unit

The developing unit 13 is arranged under the scanner unit 12. The developing unit 13 is attachable to and detachable from the body casing 2.

The developing unit 13 includes a process frame 21, and the toner cartridge 22 as one example of a second cabinet is detachably attached to the process frame 21.

Figure 2:
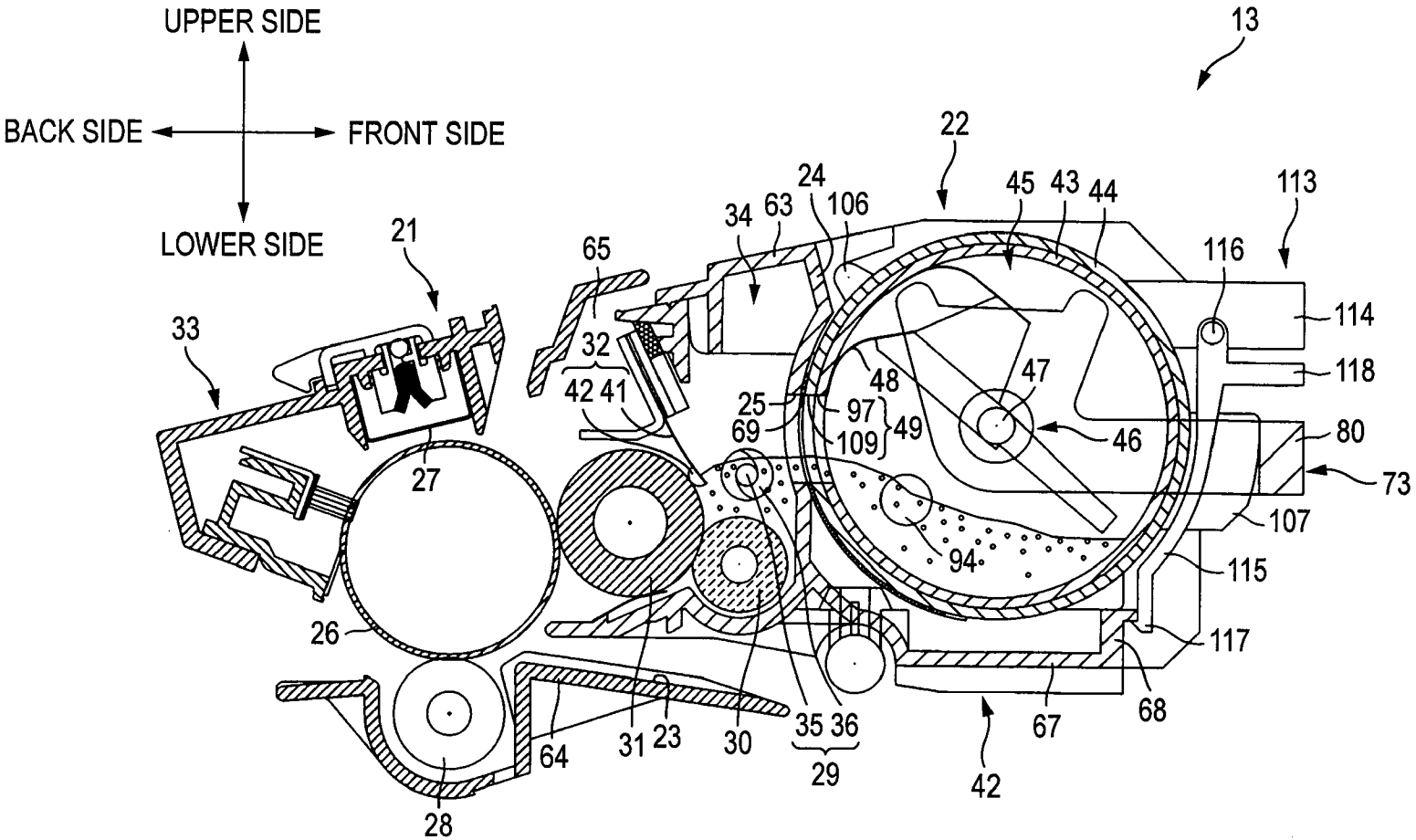
FIG. 2 is an exemplary side sectional view of a developing unit according to an aspect of the present invention wherein the developing unit is in a state in which a toner cartridge according to an aspect of the present invention is attached to a process frame.
Figure 3:
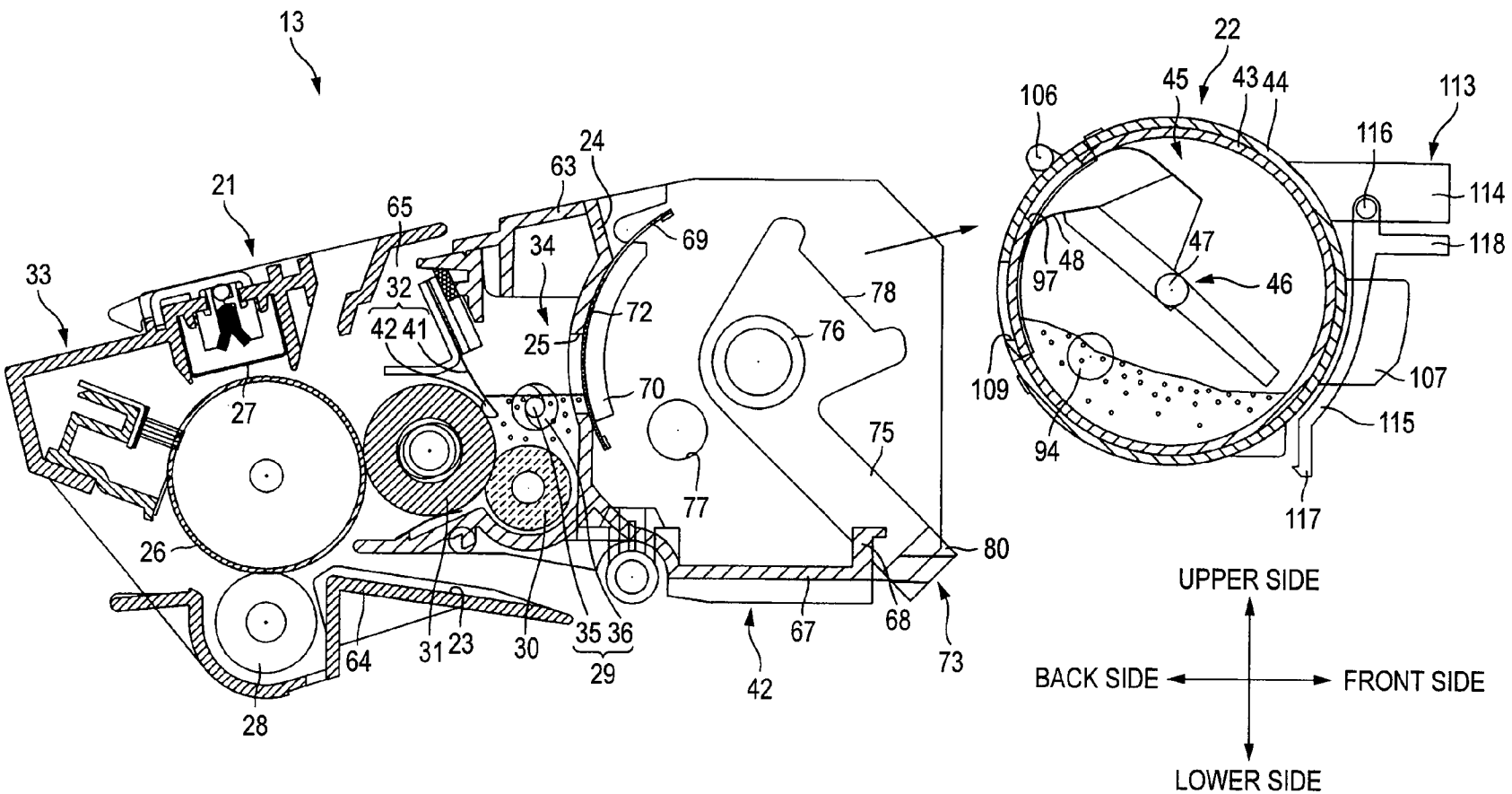
FIG. 3 is an exemplary side sectional view of the developing unit showing a state in which the toner cartridge is detached from the process frame.

FIG. 2 is an exemplary side sectional view of the developing unit 13 showing a state of attaching the toner cartridge 22 to the process frame 21. FIG. 3 is an exemplary side sectional view of the developing unit 13 and shows a state of detaching the toner cartridge 22 from the process frame 21.

The process frame 21 is formed in a substantially box shape longitudinally in a width direction. A transfer path 23 for guiding the sheet 3 between a transfer roller 28 and the photoconductive drum 26 described below is formed in a lower part of the process frame 21.

In the process frame 21, a bulkhead 24 extending in upper and lower directions and a width direction (left and right directions) is formed in the middle part of front and back directions. A frame side opening 25 as one example of an opening is formed in the bulkhead 24.

In the process frame 21, the portion of the back side from the bulkhead 24 is a process part 33 as one example of a first cabinet for receiving the photoconductive drum 26 as one example of an image carrier, an electrification device 27, the transfer roller 28 as one example of a transfer unit, a toner transport member 29 as one example of a toner transport member, a supply roller 30, a developing roller 31 as one example of a toner carrier, and a layer thickness regulating blade 32. In FIG. 2, the toner transport member 29 is embodied in the form of an auger by way of example. However, one of ordinary skill in the art will appreciate that other structures are possible for transferring the toner.

The photoconductive drum 26 and the transfer roller 28 are rotatably supported by the process frame 21. The electrification device 27 is arranged over the photoconductive drum 26. The electrification device 27 may be, for example, a scorotron type electrification device for positive electrification. The transfer roller 28 is arranged under the photoconductive drum 26.

A developing chamber 34 is provided inside the portion of about a half of front side of the process part 33. The toner transport member 29, the supply roller 30, the developing roller 31 and the layer thickness regulating blade 32 are arranged inside the developing chamber 34.

The toner transport member 29 is arranged in a position opposed to the frame side opening 25 in the back side of the frame side opening 25 as shown in FIGS. 2 and 3. The supply roller 30 is arranged under the toner transport member 29. The developing roller 31 is arranged at the back side of the supply roller 30. The toner transport member 29, the supply roller 30 and the developing roller 31 are rotatably supported by the process frame 21.

The layer thickness regulating blade 32 includes a flexible leaf spring member 41 formed in a thin plate shape, and a pressure contact rubber 42 disposed in the lower end of the leaf spring member 41. The upper end of the leaf spring member 41 is fixed to the process frame 21 at the upper side of the developing roller 31. The pressure contact rubber 42 presses a surface of a rubber roller 40 from the front side by an elastic force of the leaf spring member 41.

In the process frame 21, a portion of the front side from the bulkhead 24 forms a cartridge attachment part 42 to which the toner cartridge 22 is attached.

The toner cartridge 22 includes an inside cabinet 43 and an outside cabinet 44. The inside cabinet 43 and the outside cabinet 44 form a double cylindrical shape in which both ends are closed.

The inside cabinet 43 provides a toner reception chamber 45 for housing a toner. In the image forming apparatus 1 of the aspect, the toner comprises a suspension polymerization toner which is a nonmagnetic one-component toner with positive electrification.

An agitator 46 is disposed inside the toner reception chamber 45. The agitator 46 includes an agitator shaft 47 and an agitating blade 48 supported by the agitator shaft 47. The agitator shaft 47 extends in the width direction and is rotatably supported in the inside cabinet 43.

A cartridge side opening 49 is provided in a surface of the inside cabinet 43 and a surface of the outside cabinet 44 as shown in FIG. 2. The cartridge side opening 49 allows an inside of the toner reception chamber 45 to communicate with an outside of the toner reception chamber 45 in a state in which the toner cartridge is attached to the cartridge attachment part 42.

Toner the inside of the toner reception chamber 45 is agitated by rotation of the agitator 46. Also, by rotation of the agitator 46, the toner of the inside of the toner reception chamber 45 is transported to the cartridge side opening 49 and is discharged from the cartridge side opening 49. The toner discharged from the cartridge side opening 49 is supplied to the inside of the developing chamber 34 through the frame side opening 25. The toner supplied to the inside of the developing chamber 34 is supplied to the supply roller 30 while being transported in a width direction by rotation of the toner transport member 29.

The toner supplied to the supply roller 30 is supplied to the developing roller 31 by rotation of the supply roller 30. The toner is frictionally electrified in positive polarity between the supply roller 30 and the developing roller 31. In the toner supplied to the developing roller 31, a layer thickness of the toner is regulated by the pressure contact rubber 42 of the layer thickness regulating blade 32. Consequently, a thin layer of the toner is carried on a surface of the developing roller 31.

In contrast, a surface of the photoconductive drum 26 is positively electrified uniformly by the electrification device 27 with rotation of the photoconductive drum 26. Then, an electrostatic latent image corresponding to an image to be formed on the sheet 3 is formed by irradiating the positively electrified surface of the photoconductive drum 26 with a laser beam from the scanner unit 12 (see FIG. 1).

When the electrostatic latent image formed on the surface of the photoconductive drum 26 is opposed to the developing roller 31 by rotation of the photoconductive drum 26, the positively electrified toner carried on the surface of the developing roller 31 is supplied to the electrostatic latent image (that is, the low electric potential portion exposed by a laser beam among the surface of the photoconductive drum 26 positively electrified uniformly). Consequently, the electrostatic latent image is imaged and transferred and a toner image is carried on the surface of the photoconductive drum 26. The toner image carried on the surface of the photoconductive drum 26 is transferred to the sheet 3 when the sheet 3 conveyed from the resister rollers 10 passes between the photoconductive drum 26 and the transfer roller 28.

(3-3) Fixing Part

The fixing part 14 is disposed at the back side of the developing unit 13 as shown in FIG. 1. The fixing part 14 comprises a heating roller 50, a pressurizing roller 51 brought into pressure contact with the heating roller 50, and a pair of conveying rollers 52 arranged in the back of their rollers.

The toner image transferred to the sheet 3 is fixed to the sheet 3 by heating and pressurizing from the heating roller 50 and the pressurizing roller 51 while the sheet 3 passes between the heating roller 50 and the pressurizing roller 51. The sheet 3 to which the toner image is fixed is conveyed to the sheet discharge part 6 by the pair of conveying rollers 52.

(4) Sheet Discharge Part

The sheet discharge part 6 comprises a sheet discharge path 53, a pair of sheet discharge rollers 54, and a sheet discharge tray 55. The sheet 3 conveyed from the fixing part 14 is conveyed to the sheet discharge path 53 and is discharged on the sheet discharge tray 55 by the sheet discharge rollers 54.

(Developing Unit)

Figure 4:
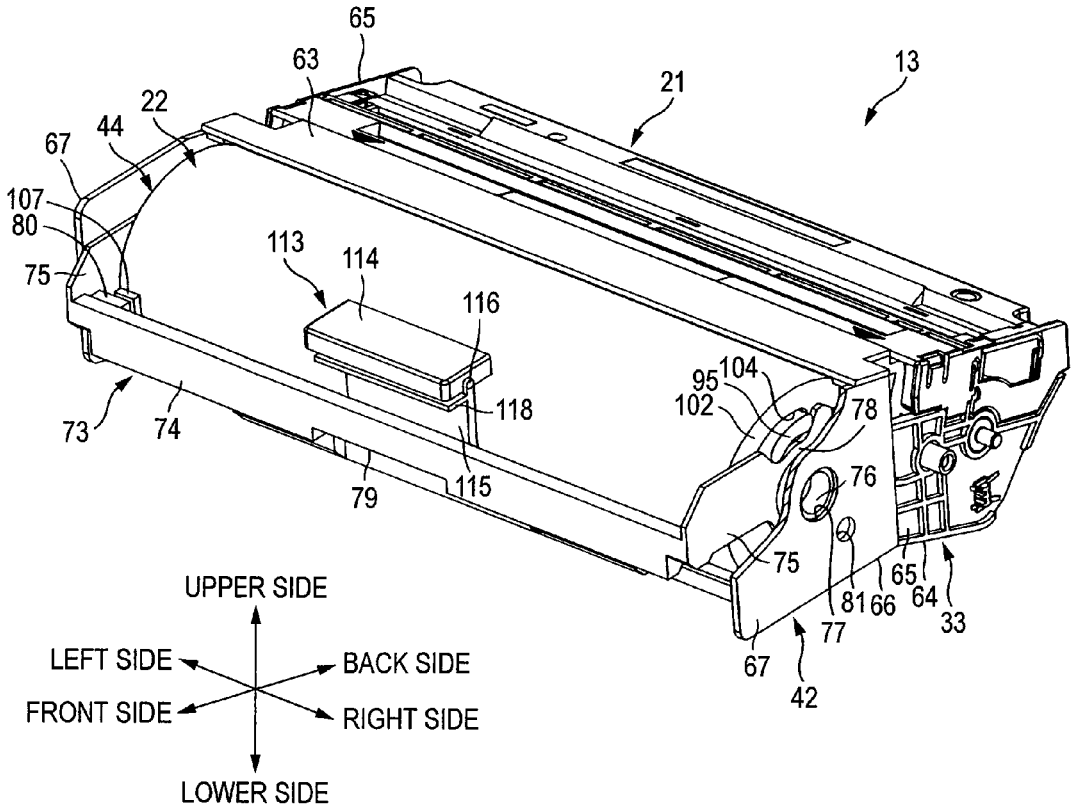
FIG. 4 is a schematic perspective view of the developing unit of FIG. 2 as viewed from a front right side of the developing unit.
Figure 5:
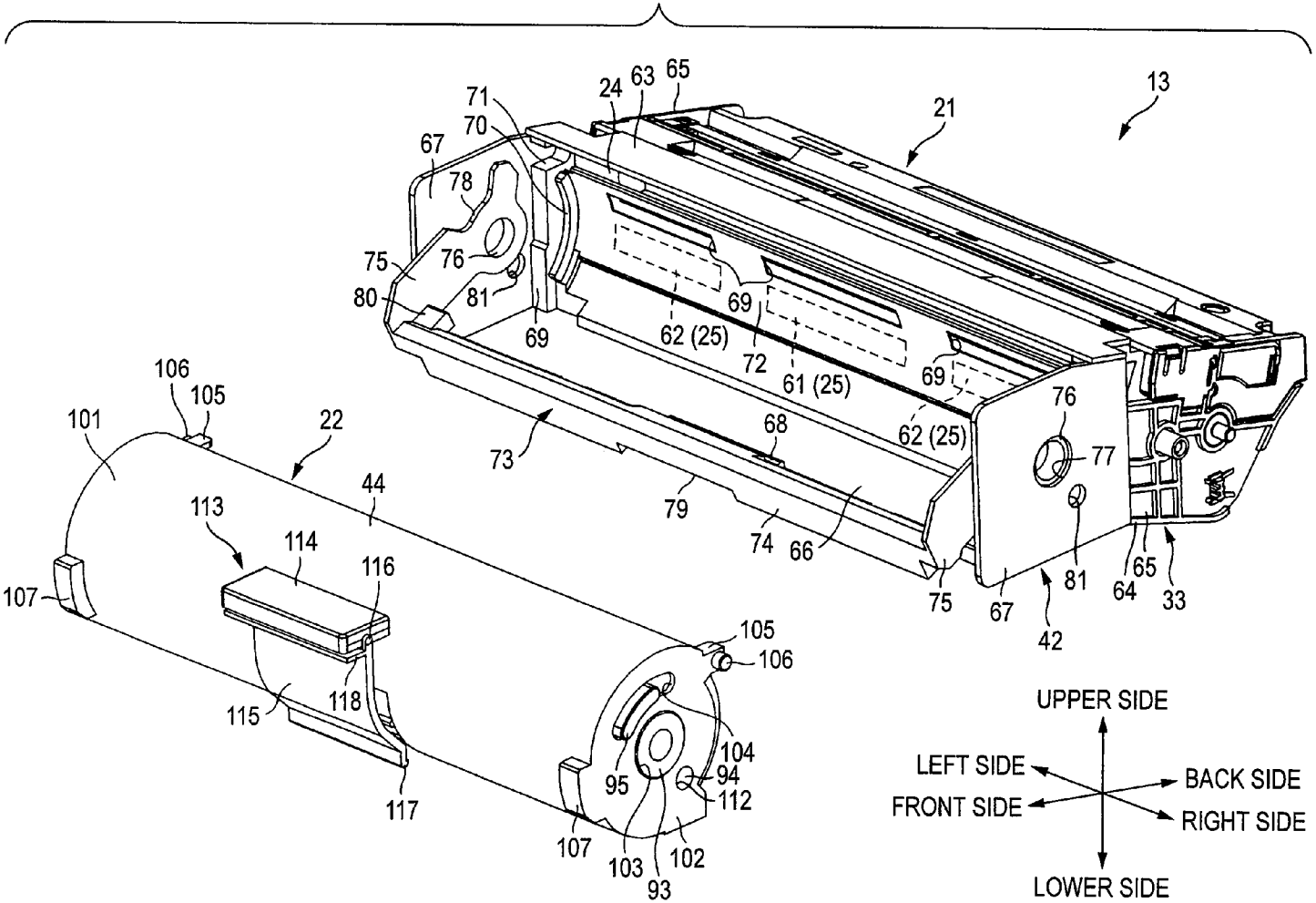
FIG. 5 is an exemplary perspective view, as viewed from the front right side of the developing unit of FIG. 3, showing the developing unit in a state in which the toner cartridge is detached from the process frame.
Figure 6:
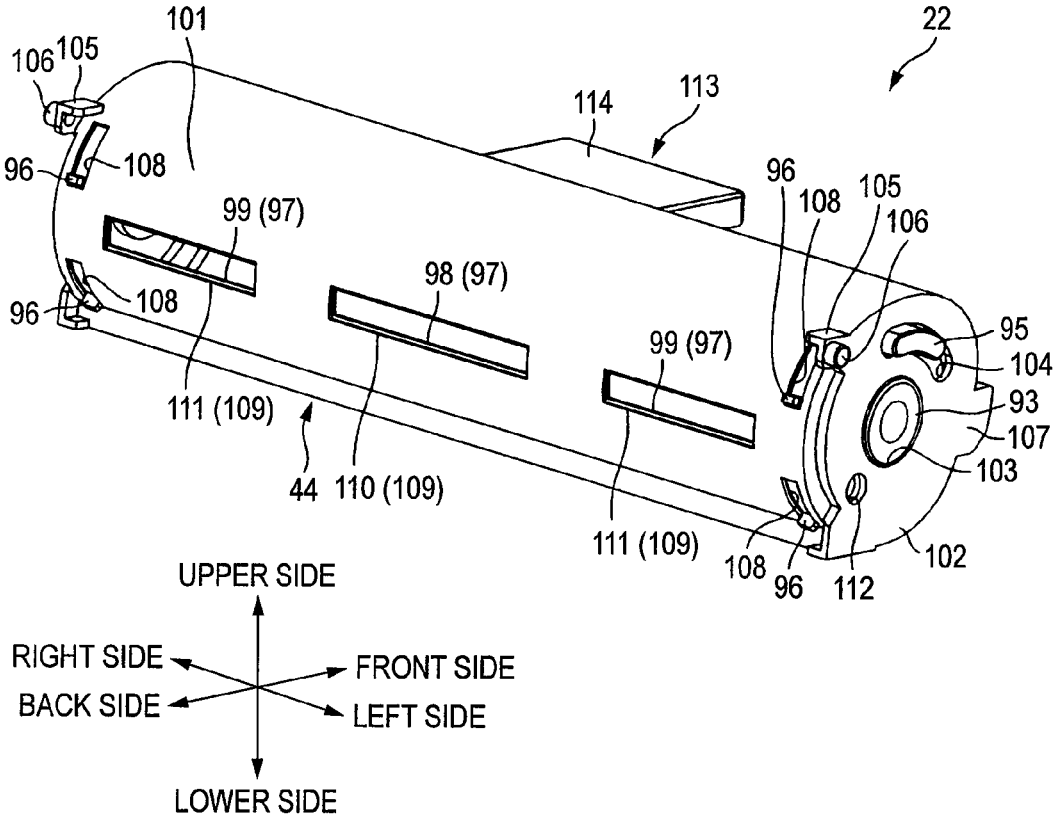
FIG. 6 is a schematic perspective view of the toner cartridge of FIG. 5, as viewed from a back left side, in a state in which an inside cabinet is in an opened position.
Figure 7:
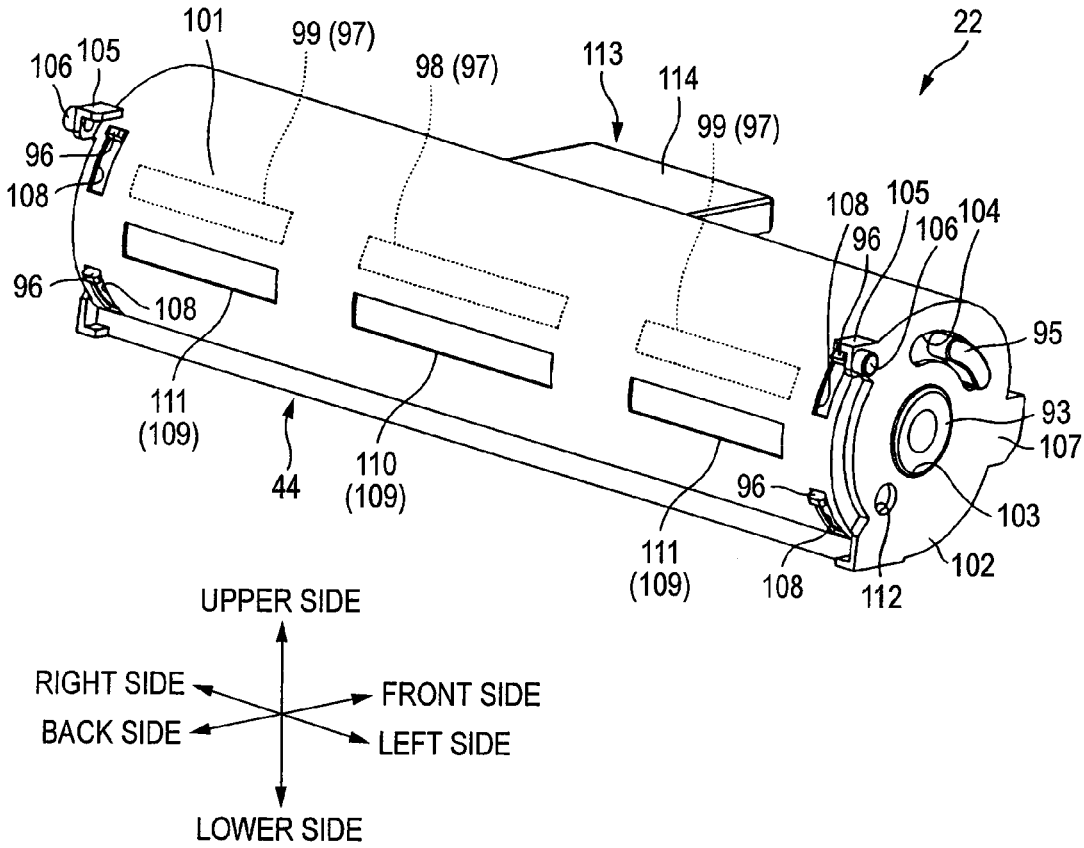
FIG. 7 is an exemplary perspective view of the toner cartridge of FIG. 5, as viewed from the back left side, in a state in which the inside cabinet is in a closed position.
Figure 8:
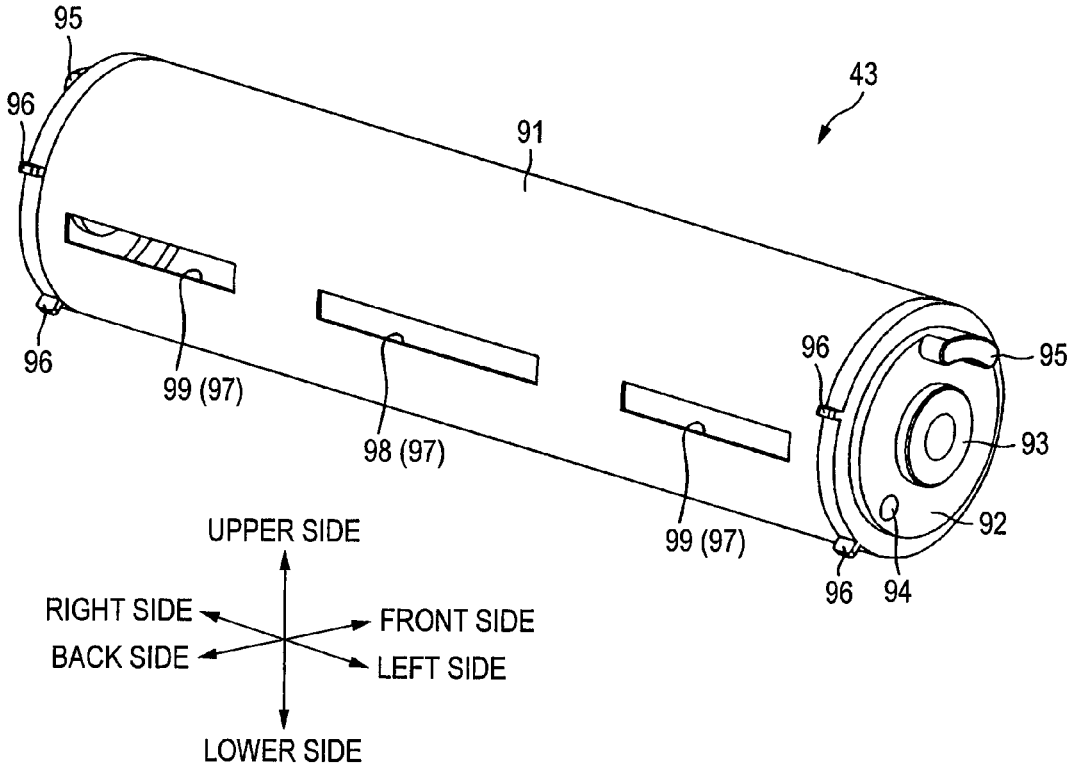
FIG. 8 is an exemplary perspective view, as viewed from a back left side, of the inside cabinet of the toner cartridge of FIG. 5.
Figure 9:
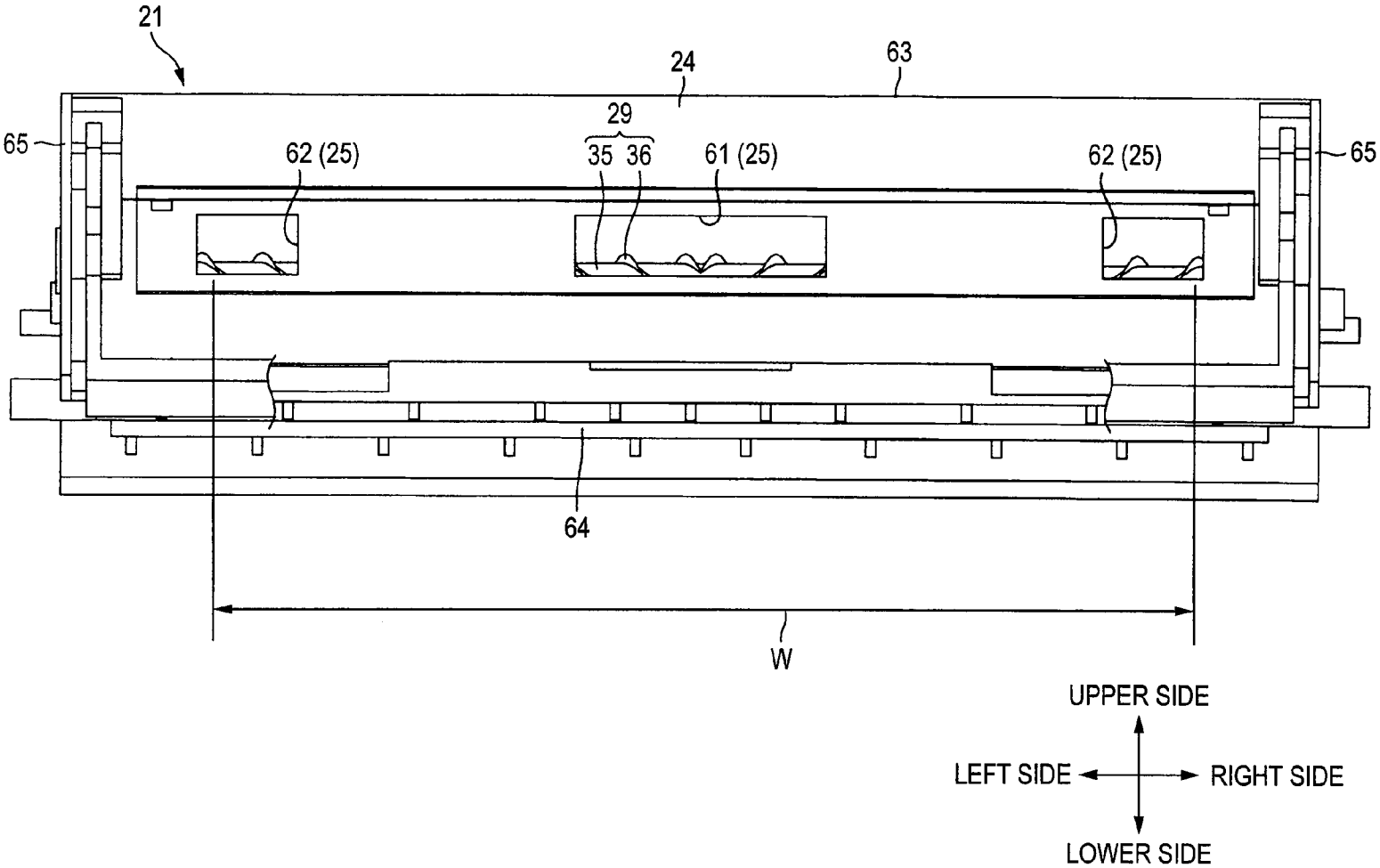
FIG. 9 is an exemplary front view of the developing unit in a state of detaching the toner cartridge from the process frame.

FIG. 4 is an exemplary perspective view as viewed from front right side of the developing unit 13 and shows a state of notching a part. FIG. 5 is an exemplary perspective view as viewed from the front right side of the developing unit 13 and shows a state of detaching the toner cartridge 22 from the process frame 21. FIGS. 6 and 7 are exemplary perspective views as viewed from the back left side of the toner cartridge 22. FIG. 8 is an exemplary perspective view of the inside cabinet 43 of the toner cartridge 22 as viewed from the back left side. FIG. 9 is an exemplary front view of the developing unit 13 in a state of detaching the toner cartridge 22 from the process frame 21.

(1) Process Frame

The process frame 21 integrally includes the bulkhead 24, the process part 33 at the back side of the bulkhead 24, and the cartridge attachment part 42 at the front side of the bulkhead 24 as described above.

(1-1) Bulkhead

The bulkhead 24 comprises a curved portion in the middle of the upper and lower directions, as shown in FIG. 2. The curved portion of the bulkhead 24 has a radius of curvature that matches an outer peripheral surface of the toner cartridge 22 as shown in FIGS. 2 and 3.

Three rectangular frame side openings 25 are formed in the curved portion of the bulkhead 24 at a spacing in the width direction as shown in FIG. 9.

The frame side opening 25 at the center is a frame side supply port 61 as one example of a supply port for supplying toner from the inside of the toner cartridge 22 (i.e., toner reception chamber 45) to the inside of the process part 33 (i.e., developing chamber 34). The frame side supply port 61 is formed in a rectangular shape longer in a width direction (i.e., a left and right direction) than a width direction of the frame side openings 25 on either side of the frame side supply port 61.

The frame side openings 25 of both sides of the frame side supply port 61 are frame side return ports 62 as one example of return ports for returning toner from the inside of the process part 33 (i.e., the developing chamber 34) to the inside of the toner cartridge 22 (i.e., the toner reception chamber 45). In these frame side return ports 62, the lengths of the width direction are respectively formed in proper lengths at proper spacing between the frame side supply port 61 and the return ports 62 so that a spacing between the right edge of the right frame side return port 62 and the left edge of the left frame side return port 62 becomes longer than a width W of an image forming region in which a toner image is formed on a surface of the photoconductive drum 26.

(1-2) Process Part

The process part 33 integrally includes an upper wall 63 backward extending from the upper edge of the bulkhead 24, a bottom wall 64 backward extending from the lower edge of the bulkhead 24, and side walls 65 respectively backward extending from both edges of the width direction of the bulkhead 24.

The toner transport member 29 arranged in the process part 33 includes an toner transport member shaft 35, and a screw 36 disposed around the toner transport member shaft 35. The toner transport member shaft 35 extends in the width direction and both ends of the toner transport member shaft 35 are rotatably supported in the process frame 21. The toner transport member shaft 35 is rotated by driving force from a motor (not shown) at the time of forming an image. The screws 36 are respectively disposed to both sides with respect to the center of the width direction in the toner transport member shaft 35 and are formed in a spiral shape for transporting toner from the center of the width direction to both outsides of the width direction as shown in FIG. 9.

(1-3) Cartridge Attachment Part

The cartridge attachment part 42 integrally includes a bottom plate 66 forward extending from the lower edge of the bulkhead 24, and side plates 67 respectively forward extending from both edges of the width direction of the bulkhead 24 as shown in FIG. 5.

The bottom plate 66 is integrally formed continuously with the bottom wall 64 of the process part 33.

A lower side fixed part 68 slightly protruding to the front side is provided in the center of the width direction of the front edge as shown in FIGS. 2, 3 and 5.

Each of the side plates 67 is integrally formed continuously with both the side walls 65 of the process part 33.

A shutter support part 69 is disposed on an inside surface of the width direction of the back end of each of the side plates 67 as shown in FIG. 5. Each of the shutter support parts 69 has a substantially rectangular shape extending in the upper and lower directions and extends inwardly from the inside surface of the width direction of both the side plates 67.

A shutter guide part 70 is disposed on an inside surface of the width direction of each of the shutter support parts 69. Each of the shutter guide parts 70 forms a protrusion stripe extending inwardly from the inside surface of the width direction of the shutter support part 69. Also, each of the shutter guide parts 70 has a substantially curved shape with substantially the same curvature as that of the curved portion of the bulk head 24. Each of the shutter guide parts 70 is arranged in a position opposed to the curved portion of the bulkhead 24 at a slight spacing from the bulkhead 24 in the front and back directions.

An upper end surface of each of the shutter support parts 69 is arranged in a position slightly lower than the upper edge of each of the side plates 67. The upper end surface of each of the shutter support parts 69 forms an upper side fixed part 71.

Also, a shutter 72 for opening and closing the frame side openings 25 is disposed in the cartridge attachment part 42.

The shutter 72 has a substantially rectangular shape extending in the width direction and has a substantially curved shape with substantially the same curvature as that of the curved portion of the bulkhead 24. The shutter 72 is formed slightly shorter than the shutter guide parts 70 in the upper and lower directions. Also, three shutter opening parts 69, corresponding to each of the frame side openings 25, are provided in the shutter 72.

The shutter 72 is arranged in a position opposed to the curved portion of the bulkhead 24, and both ends of a width direction of the shutter 72 are slidably pinched between the bulkhead 24 and each of the shutter guide parts 70 as shown in FIG. 3. Accordingly, the shutter 72 can slide along each of the shutter guide parts 70 in the upper and lower directions between an opened position (see FIG. 2) in which the frame side openings 25 are opened and a closed position (see FIGS. 3 and 5) in which the frame side openings 25 are closed. When the shutter 72 is in the opened position, the shutter opening parts 69 in a position corresponding respectively to the frame side openings 25 and each of the frame side openings 25 is opened. When the shutter 72 is in the closed position, the portions of the shutter 72 below the shutter opening parts 69 are in a position corresponding respectively to the frame side openings 25 and each of the frame side openings 25 is closed.

Also, a swing arm 73 is disposed in the cartridge attachment part 42 as shown in FIGS. 4 and 5. The swing arm 73 has a substantially U shape in the case of being viewed from the plane. The swing arm 73 integrally comprises a grasp bar 74 extending in the width direction, and arm side plates 75 extending backward from both ends of the width direction of the grasp bar 74.

A boss 76 protruding outward in the width direction is disposed at the back end of each of the arm side plates 75. Each of the bosses 76 is turnably supported by a circular hole 77 provided in the center of each of the side plates 67.

Also, a receiving recessed part 78 notched so as to be recessed to the lower side is provided in the upper side edge at the back end of each of the arm side plates 75.

A grasp part 79 recessed to the upper side is provided in the center of the width direction of the grasp bar 74. Also, backward extending press protrusion parts 80 with rectangular shapes in the case of being viewed from the rear are disposed in both ends of the width direction of the grasp bar 74.

Using the boss 76 of each of the arm side plates 75 as a fulcrum, the swing arm 73 swings between a pressing release position (see FIGS. 3 and 5) in which the lower edge of each of the arm side plates 75 makes contact with the front edge of the bottom plate 66 and a pressing position (see FIGS. 2 and 4) in which the toner cartridge 22 is pressed from the front side if the toner cartridge 22 is received in the cartridge attachment part 42.

A light passage hole 81 for passing detection light of a toner sensor 130 described below is formed in the lower front side of the circular hole 77 in each of the side plates 67 as shown in FIGS. 3 and 4. The light passage holes 81 of each of the side plates 67 are mutually opposed in the width direction.

(2) Toner Cartridge

The toner cartridge 22 includes the inside cabinet 43 for housing a toner, and the outside cabinet 44 for receiving the inside cabinet 43 as described above.

(2-1) Inside Cabinet

The inside cabinet 43 integrally includes a cylindrical inside peripheral wall 91 extending in the width direction, and circular plate-shaped inside side walls 92 for closing both ends of the width direction of the inside peripheral wall 91 as shown in FIG. 8.

A boss part 93 with a circular thick plate shape outward extending in the width direction is disposed in the center of each of the inside side walls 92.

An inside window 94 opposed to an outside hole 112 of the outside cabinet 44 described below in the width direction is formed in the lower back side of the boss part 93 in each of the inside side walls 92. Both the inside windows 94 are mutually opposed in the width direction.

A slide protrusion 95 is disposed in an upper side portion of each of the inside side walls 92. The slide protrusion 95 is formed in a circular arc shape (e.g., a circular arc shape with a center angle of about 45°) in the case of being viewed from the side along an outer peripheral surface of the inside side wall 92, and is disposed so as to protrude from the inside side wall 92 to the outside of the width direction.

A pair of pinch protrusions 96 radially protruding from a peripheral end surface are disposed in a back side portion of each of the inside side walls 92. The pair of pinch protrusions 96 are arranged at a spacing (i.e., spacing corresponding to a circumferential length of the shutter 72) in a circumferential direction mutually in the peripheral end surface of each of the inside side walls 92.

In the inside peripheral wall 91, three inside passage ports 97 are formed at a spacing in the width direction in a surrounded portion surrounded by a rectangle with the corners of the pair of pinch protrusions 96 (i.e., there are four pinch protrusions 96) arranged in both sides of the width direction.

Each of the inside passage ports 97 is formed in a substantially rectangular shape elongated in the width direction.

The inside passage port 97 of the center is an inside supply port 98 as one example of a supply port for supplying toner from the inside of the toner cartridge 22 (i.e, the toner reception chamber 45) to the inside of the process part 33 (i.e., the developing chamber 34).

The inside passage ports 97 of both sides of the inside supply port 98 are inside return ports 99 as one example of return ports for returning toner from the inside of the process part 33 (i.e., developing chamber 34) to the inside of the toner cartridge 22 (i.e., toner reception chamber 45). In these inside return ports 99, the lengths of the width direction are respectively formed in proper lengths at proper spacings between the inside supply port 98 and the return ports 99 so that a spacing between the right edge of the right inside return port 99 and the left edge of the left inside return port 99 becomes longer than a width W (see FIG. 9) of an image forming region in which a toner image is formed on a surface of the photoconductive drum 26.

(2-2) Outside Cabinet

The outside cabinet 44 is formed slightly larger than the inside cabinet 43 in the width and radial directions in order that the outside cabinet 44 may turnably receive the inside cabinet 43. The outside cabinet 44 integrally includes an outside peripheral wall 101 with a substantially cylindrical shape extending in the width direction, and circular plate-shaped outside side walls 102 for closing both ends of the width direction of the outside peripheral wall 101 as shown in FIG. 7.

A circular boss hole 103 for receiving the boss part 93 is formed in each of the outside side walls 102.

A slide hole 104 into which the slide protrusion 95 is inserted is formed in each of the outside side walls 102. The slide hole 104 has a circular arc shape (e.g., a circular arc shape with a center angle of about 90°) with a circumferential length longer than that of the slide protrusion 95 in the case of being viewed from the side, and extends between the upper front side and the upper back side of the boss hole 103.

Further, the outside hole 112 opposed to the inside window 94 of the inside cabinet 43 is formed in each of the outside side walls 102.

A backward protruding upper side part 105 to be fixed is formed on a peripheral end surface of each of the outside side walls 102. A positioning boss 106 outward protruding in the width direction is disposed in the back end of each of the upper side parts 105 to be fixed.

A forward extending pressed part 107 is disposed on the peripheral end surface of each of the outside side walls 102 as shown in FIG. 5. Each of the pressed parts 107 is formed in a substantially rectangular shape in the case of being viewed from the front and a substantially circular arc shape in the case of being viewed from the side.

Four elongated holes 108 into which the pair of pinch protrusions 96 (i.e., there are four pinch protrusions 96) are respectively inserted are provided at both ends of the width direction in the outside peripheral wall 101 as shown in FIG. 7. Each of the elongated holes 108 is formed in a substantially rectangular shape extending in the upper and lower directions in the case of being viewed from the rear and is formed in a length corresponding to a swing range between the opened position and the closed position of the shutter 72.

In the outside peripheral wall 101, three outside passage ports 109 are formed at a spacing in the width direction in a portion of the outside peripheral wall 101 surrounded by a rectangle with corners at the four elongated holes 108.

Each of the outside passage ports 109 is formed in a substantially rectangular shape elongated in the width direction.

The outside passage port 109 of the center is an outside supply port 110 as one example of a supply port for supplying toner from the inside of the toner cartridge 22 (i.e., the toner reception chamber 45) to the inside of the process part 33 (i.e., the developing chamber 34).

The outside passage ports 109 of both sides of the outside supply port 110 are outside return ports 111 as one example of return ports for returning toner from the inside of the process part 33 (i.e., the developing chamber 34) to the inside of the toner cartridge 22 (i.e., the toner reception chamber 45).

The outside supply port 110 corresponds the frame side supply port 61 and is located in a position opposite to the frame side supply port 61, and each of the outside return ports 111 corresponds to respective frame side return ports 62 in a state in which the toner cartridge 22 is attached to the process frame 21 as shown in FIG. 2.

In the front side of the outside peripheral wall 101, a grip part 113 is disposed in the center of the width direction as shown in FIG. 5.

The grip part 113 includes an upper grasp plate 114 with a substantially rectangular shape forward protruding from the outside peripheral wall 101, and a locking arm 115 with a substantially J shape in the case of being viewed from the side downward extending from the upper grasp plate 114. The upper end of the locking arm 115 is swingably supported by a support shaft 116 disposed in the upper grasp plate 114. A locking claw 117 for locking in the lower side fixed part 68 is disposed in the lower end of the locking arm 115. A lower grasp plate 118 with a substantially rectangular shape protruding forward is disposed in the vicinity of the upper end of the locking arm 115. The lower grasp plate 118 is arranged so as to extend in a space parallel with the upper grasp plate 114.

A compression spring (not shown) for urging the upper and lower grasp plates in a direction of separation is interposed between the upper grasp plate 114 and the lower grasp plate 118.

(2-3) Relative Arrangement of Inside Cabinet and Outside Cabinet

The inside cabinet 43 is turnably received inside the outside cabinet 44.

More specifically, an outer peripheral surface of the inside peripheral wall 91 is inward fitted slidably in a circumferential direction with respect to an inner peripheral surface of the outside peripheral wall 101. Outer peripheral surfaces of both the inside side walls 92 are inward fitted slidably in a circumferential direction with respect to inner peripheral surfaces of both the outside side walls 102. The boss part 93 is turnably supported in the boss hole 103 as shown in FIGS. 6 and 7. The slide protrusion 95 is inserted into the slide hole 104. Each of the pinch protrusions 96 is inserted into each of the elongated holes 108, and each of the pinch protrusions 96 is protruded from each of the elongated holes 108 to the outside of a radial direction. The inside window 94 of the inside cabinet 43 is opposed to the outside hole 112 of the outside cabinet 44.

The inside cabinet 43 permits relative turns using the boss part 93 as a fulcrum between a closed position (see FIG. 7) in which the inside passage ports 97 are not opposed to the outside passage ports 109 and an opened position (see FIG. 6) in which the inside passage ports 97 are opposed to the outside passage ports 109 with respect to the outside cabinet 44.

When the inside cabinet 43 is in the closed position, each of the slide protrusions 95 is arranged in the front end of each of the slide holes 104 as shown in FIG. 7. Each of the pinch protrusions 96 is arranged in the upper end of each of the elongated holes 108. The inside passage ports 97 are arranged in a position above the outside passage ports 109, and the outside passage ports 109 are closed by the inside peripheral wall 91 of the inside cabinet 43.

The inside cabinet 43 is relatively turned in a direction (lower side) in which the inside passage ports 97 move toward the outside passage ports 109 with respect to the outside cabinet 44 using the boss part 93 as a fulcrum. Then, each of the slide protrusions 95 slides each of the slide holes 104 from the front end toward the back end. Each of the pinch protrusions 96 slides each of the elongated holes 108 from the upper end toward the lower end.

When each of the slide protrusions 95 abuts on the back edge of each of the slide holes 104 and each of the pinch protrusions 96 abuts on the lower edge of each of the elongated holes 108, the inside cabinet 43 is arranged in the opened position as shown in FIG. 6.

When the inside cabinet 43 is in the opened position, each of the slide protrusions 95 is arranged in the back end of each of the slide holes 104. Also, each of the pinch protrusions 96 is arranged in the lower end of each of the elongated holes 108. Then, the inside passage ports 97 are opposed to the outside passage ports 109 and these passage ports communicate with each other and are opened.

In addition, when the inside cabinet 43 is returned to the closed position, the inside cabinet 43 is relatively turned in a direction in which the inside passage ports 97 rise from the outside passage ports 109 with respect to the outside cabinet 44 using the boss part 93 as the fulcrum.

(3) Attachment and Detachment of Toner Cartridge to and from Process Frame (3-1) Attachment of Toner Cartridge to Process Frame Referring to FIG. 5, when the toner cartridge 22 is attached to the process frame 21, the upper grasp plate 114 and the lower grasp plate 118 of the grip part 113 are pinched in a direction in which the grasp plates move near to each other. Then, the toner cartridge 22 is attached to the cartridge attachment part 42 of the process frame 21. The inside cabinet 43 of the toner cartridge 22 is arranged in the closed position. Also, the shutter 72 of the cartridge attachment part 42 is arranged in the closed position. The swing arm 73 is arranged in a pressing release position.

When the toner cartridge 22 is attached to the cartridge attachment part 42, each of the positioning bosses 106 is placed on each of the upper side fixed parts 71 and a pair of the pinch protrusions 96 (see FIGS. 6 and 7) on both sides in the width direction respectively pinch the upper edge and the lower edge on both ends in the width direction of the shutter 72 and each of the slide protrusions 95 is fitted into each of the receiving recessed parts 78.

Thereafter, when the pinch of the grip part 113 is released, the locking claw 117 is locked in the lower side fixed part 68 as shown in FIG. 2.

The outside cabinet 44 is fixed to the cartridge attachment part 42 since the positioning bosses 106 are placed to the upper side fixed parts 71 (see FIG. 5) and the locking claw 117 is locked to the lower side fixed part 68.

The swing arm 73 is swung from the pressing release position to a pressing position. Each of the press protrusion parts 80 presses each of the pressed parts 107 toward the back side as shown in FIGS. 2 and 4. Consequently, the toner cartridge 22 is pressed toward the process part 33.

Also, when the swing arm 73 is swung from the pressing release position to the pressing position, with swing of each of the arm side plates 75, each of the slide protrusions 95 fitted into each of the receiving recessed parts 78 slides each of the slide holes 104 to the back side and is arranged in the back end of each of the slide holes 104. Further, with the shutter 72 pinched, a pair of the pinch protrusions 96 on both sides in the width direction slides each of the elongated holes 108 to the lower side and is arranged in the lower end of each of the elongated holes 108 (see FIG. 6).

Accordingly, the inside cabinet 43 is arranged in the opened position as shown in FIG. 2. Then, the inside passage ports 97 are opposed to the outside passage ports 109 and these passage ports are communicated and opened. Thus, the cartridge side opening 49 as one example of an opening is formed.

At the time of forming an image, by the agitating blade 48 of the agitator 46, toner of the inside of the toner reception chamber 45 (i.e., in the inside cabinet 43) is transported to the cartridge side opening 49 made of the inside supply port 98 and the outside supply port 110 and is discharged from the cartridge side opening 49. The toner discharged from the cartridge side opening 49 is supplied to the inside of the developing chamber 34 (i.e., process part 33) through the frame side supply port 61.

By the toner transport member 29, the toner supplied from the frame side supply port 61 to the inside of the process part 33 is transported from the center of the width direction to both sides of the width direction and is supplied to the supply roller 30 on the way. The toner supplied to the supply roller 30 is supplied to the developing roller 31 as described above. The toner which has not been supplied to the supply roller 30 and the toner scraped down from the developing roller 31 by the layer thickness regulating blade 32 or the supply roller 30 are transported to the frame side return ports 62 and pass through the cartridge side opening 49 made of the inside return ports 99 and the outside return ports 111 and are returned to the inside of the toner reception chamber 45. Accordingly, the toner is circulated between the developing chamber 34 and the toner reception chamber 45.

In a state of attaching the toner cartridge 22 to the process frame 21, the outside hole 112 and the inside window 94 opposed in the toner cartridge 22 are opposed to the light passage hole 81 in the width direction.

(3-2) Detachment of Toner Cartridge from Process Frame

When the toner cartridge 22 is detached from the process frame 21, the swing arm 73 is first swung from the pressing position to the pressing release position. Then, each of the press protrusion parts 80 is separated from each of the pressed parts 107 and a press of the toner cartridge 22 on the process part 33 is released.

Also, when the swing arm 73 is swung from the pressing position to the pressing release position, with swing of each of the arm side plates 75, each of the slide protrusions 95 fitted into each of the receiving recessed parts 78 slides each of the slide holes 104 to the front side and is arranged in the front end of each of the slide holes 104 as shown in FIG. 7. Further, with the shutter 72 pinched, a pair of the pinch protrusions 96 on both sides in the width direction slides each of the elongated holes 108 to the upper side and is arranged in the upper end of each of the elongated holes 108.

Consequently, the inside cabinet 43 is arranged in the closed position, and the inside peripheral wall 91 of the inside cabinet 43 is opposed to the outside passage ports 109, and the outside passage ports 109 are closed. Also, the shutter 72 is arranged in the closed position, and the frame side openings 25 are opposed to the shutter 72 and are closed.

When the upper grasp plate 114 and the lower grasp plate 118 of the grip part 113 are pinched in a direction in which the grasp plates move near to each other, the locking mechanism of the locking claw 117 to the lower side fixed part 68 is released, so that when the toner cartridge 22 is pulled from the cartridge attachment part 42 to the front side, the toner cartridge 22 is detached from the process frame 21 as shown in FIG. 5.

(Control Unit of Image Forming Apparatus)

Figure 10:
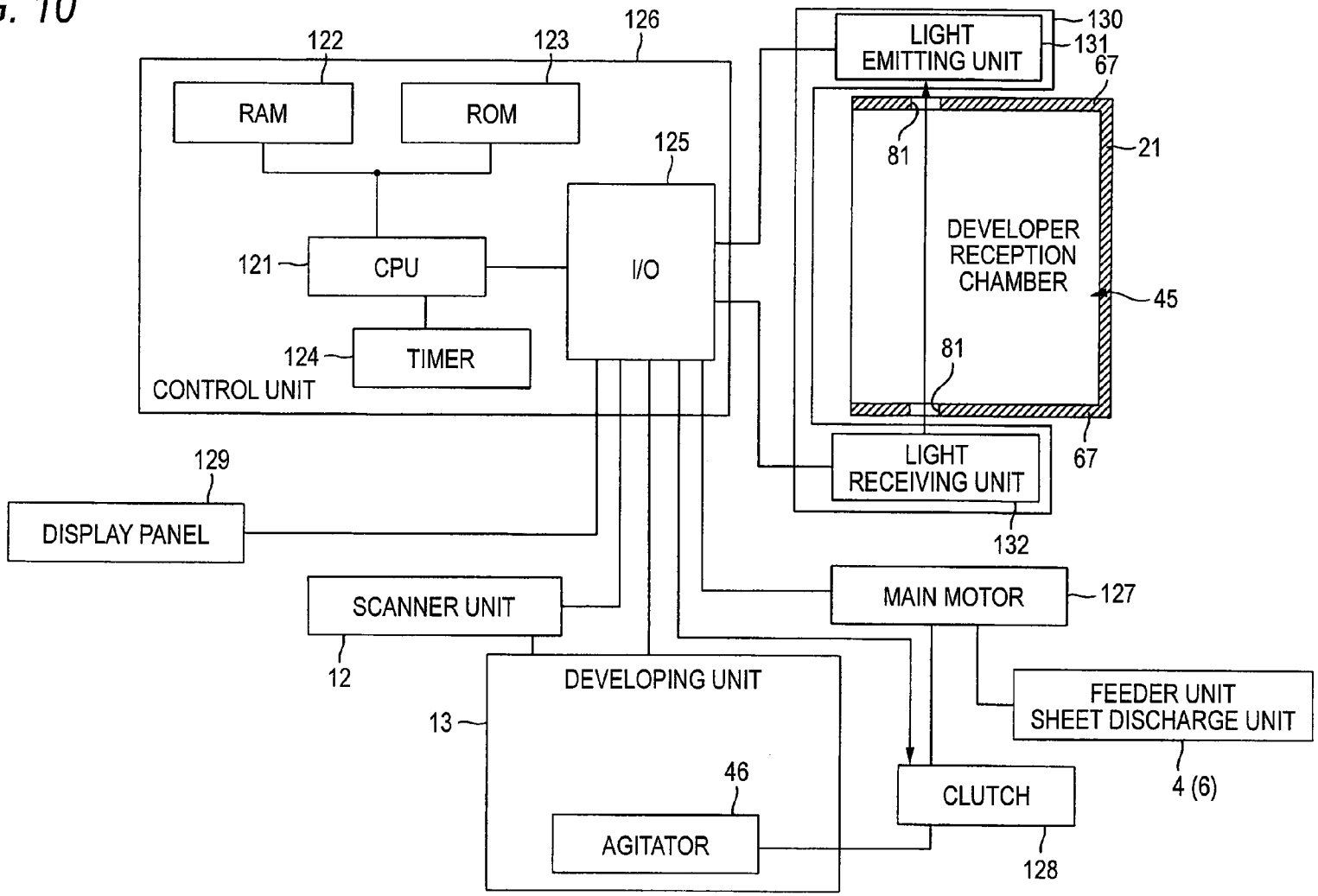
FIG. 10 is an exemplary block diagram showing an electrical configuration of the image forming apparatus.

FIG. 10 is an exemplary block diagram showing an electrical configuration of the image forming apparatus 1.

The image forming apparatus 1 includes a control unit 126 of a configuration including a CPU 121, RAM 122, ROM 123, a timer 124 and an I/O port 125. The CPU 121 as one example of an empty decision unit, a toner supply stop unit, a toner return unit, an empty notification unit and toner consumption means is electrically connected to the RAM 122, the ROM 123, the timer 124 and the I/O port 125.

The scanner unit 12 and the developing unit 13 are connected to the I/O port 125.

A main motor 127 arranged inside the body casing 2 (see FIG. 1) is connected to the I/O port 125. Driving force of the main motor 127 is used in driving of various rollers of the feeder unit 4 and the sheet discharge unit 6 and driving of the photoconductive drum 26, the electrification device 27, the transfer roller 28, the toner transport member 29, the supply roller 30, the developing roller 31 and the agitator 46 mounted in the developing unit 13.

A clutch 128 is interposed between the main motor 127 and the agitator 46 (agitator shaft 47). By on/off of the clutch 128, the driving force from the main motor 127 can be transmitted and broken with respect to the agitator 46. The clutch 128 is connected to the I/O port 125.

Further, a display panel 129 for performing various display is connected to the I/O port 125. The display panel 129 is arranged on, for example, an upper surface of the body casing 2.

The image forming apparatus 1 includes a toner sensor 130 for detecting the remaining amount of toner of the inside of the toner reception chamber 45. The toner sensor 130 is constructed of a light emitting unit 131 for emitting detection light made of a laser beam, and a light receiving unit 132 for receiving the detection light from the light emitting unit 131.

The light emitting unit 131 and the light receiving unit 132 are arranged in both sides of the width direction in a state of sandwiching the process frame 21 between the light emitting unit 131 and the light receiving unit 132, and are respectively opposed to the light passage holes 81 of the side plates 67 from the outside of the width direction. In a state of attaching the toner cartridge 22 (see FIG. 6) to the process frame 21, the outside holes 112 and the inside windows 94 of the toner cartridge 22 are opposed to the light passage holes 81 in the width direction as described above, so that the light passage holes 81, the inside windows 94 and the outside holes 112 line on an optical path of the detection light emitted from the light emitting unit 131 toward the light receiving unit 132. Therefore, when the toner is not present between both the inside windows 94, the detection light from the light emitting unit 131 passes through the inside of the toner reception chamber 45 and is received by the light receiving unit 132.

In addition, illustration of the toner cartridge 22 is omitted in FIG. 10.

The light emitting unit 131 and the light receiving unit 132 are connected to the I/O port 125. For example, while the light receiving unit 132 receives the detection light from the light emitting unit 131, a low level signal is outputted from the light receiving unit 132 and the low level signal is inputted to the CPU 121 through the I/O port 125. In contrast, while the light receiving unit 132 does not receive the detection light from the light emitting unit 131, a high level signal is outputted from the light receiving unit 132 and the high level signal is inputted to the CPU 121 through the I/O port 125.

When the clutch 128 is turned on by a command from the CPU 121, driving force of the main motor 127 is transmitted to the agitator 46 and the agitator 46 is driven at a constant rotational speed. When the agitating blade 48 (see FIG. 2) of the agitator 46 passes between both the inside windows 94, toner between both the inside windows 94 is pushed away by the agitating blade 48 and it changes to a state in which the toner is not present between both the inside windows 94. As a result, the detection light from the light emitting unit 131 is received by the light receiving unit 132, a low level signal from the light receiving unit 132 is inputted to the CPU 121. In a state in which the toner is sufficiently present inside the toner reception chamber 45, immediately after the agitating blade 48 passes between both the inside windows 94, the toner returns to a position opposed to the inside windows 94 and the detection light from the light emitting unit 131 is blocked by the toner. As a result, a signal outputted from the light receiving unit 132 is immediately shifted from the low level signal to a high level signal. As the amount of toner of the inside of the toner reception chamber 45 decreases, the return of the toner becomes slow and accordingly, time for which the low level signal is outputted from the light receiving unit 132 becomes long. Therefore, the CPU 121 can detect the amount of toner remaining inside the toner reception chamber 45 based on the output time of the low level signal from the light receiving unit 132.

In addition, in this aspect, toner amount detector is constructed of the CPU 121 and the toner sensor 130. The empty notification unit is constructed of the CPU 121 and the display panel 129.

At the time of forming an image, toner is circulated between the developing chamber 34 and the toner reception chamber 45 and a certain amount of toner is present inside the developing chamber 34. When the same amount of toner as the certain amount of toner remains inside the toner reception chamber 45, the output time of the low level signal from the light receiving unit 132 becomes a substantially constant time and the constant time can be obtained by measurement previously. The CPU 121 decides that a remaining state of the toner in the inside of the toner reception chamber 45 is an empty state when the output time of the low level signal from the light receiving unit 132 matches with time in which a predetermined margin time is added to the constant time obtained by measurement. That is, it can be decided that the remaining state of the toner in the inside of the toner reception chamber 45 is the empty state before the amount of toner of the inside of the toner reception chamber 45 becomes smaller than the amount of toner of the inside of the developing chamber 34.

When the CPU 121 decides that the remaining state of the toner in the inside of the toner reception chamber 45 is the empty state, the following empty processing is executed.

(Empty Processing)

Figure 11:
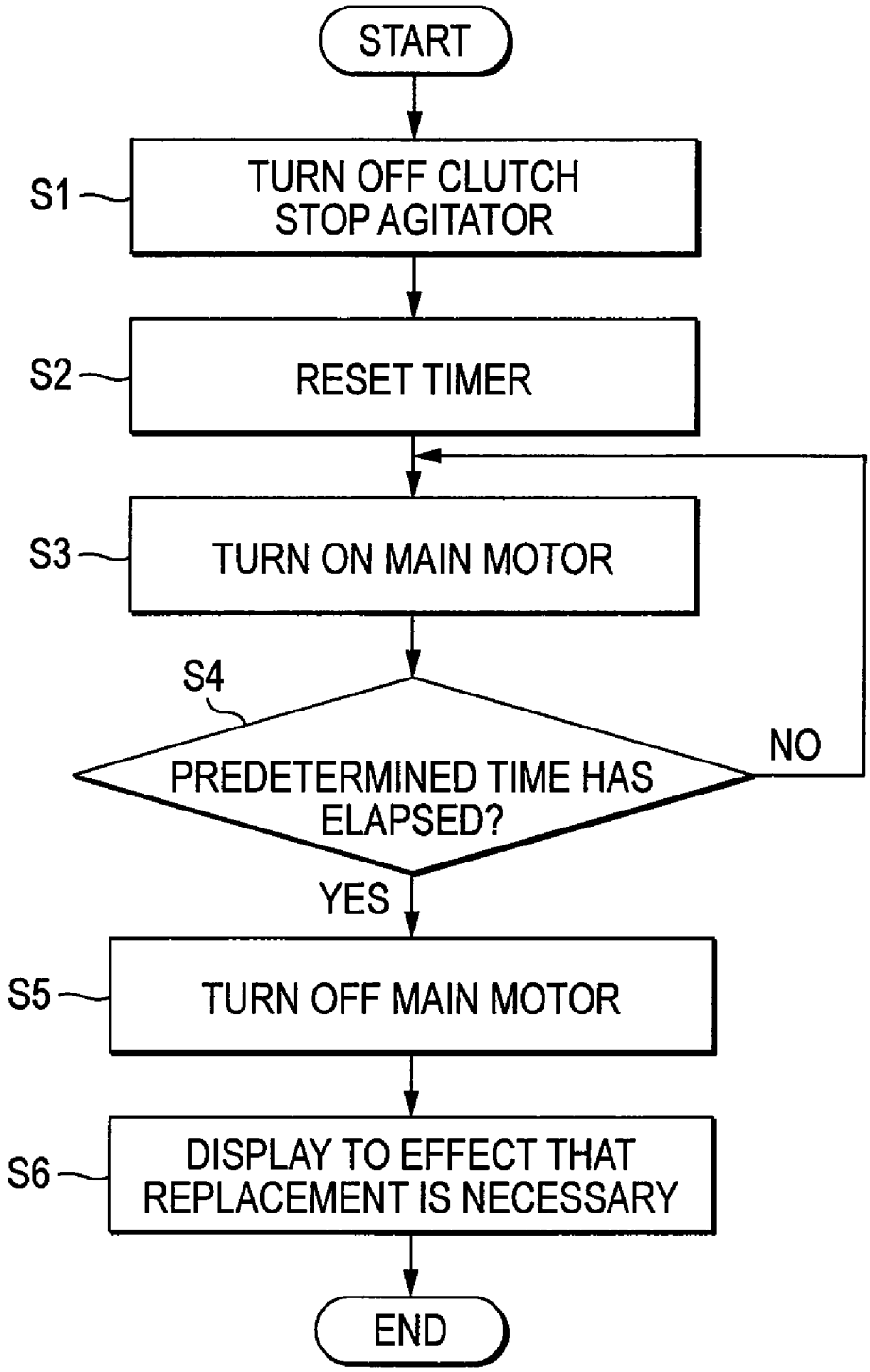
FIG. 11 is an exemplary flowchart showing a flow of empty processing.

FIG. 11 is a flowchart showing a flow of empty processing.

In the empty processing, the clutch 128 is first turned off. Accordingly, transmission of driving force from the main motor 127 to the agitator 46 is broken and the agitator 46 is stopped (S1).

Next, the timer 124 is reset (S2). Then, measurement of time elapsed since the clutch 128 was turned off is started by the timer 124.

Thereafter, a driving state (ON) of the main motor 127 is maintained until a predetermined time (for example, three minutes) is measured by the timer 124 (S3, S4). During this period, in a state in which the agitator 46 stops, the driving force of the main motor 127 is transmitted to the toner transport member 29 and the toner transport member 29 is driven. The agitator 46 stops, so that toner is not supplied from the inside of the toner reception chamber 45 to the developing chamber 34. In contrast, the toner transport member 29 is driven, so that the toner of the inside of the developing chamber 34 is transported from the center of the width direction to both sides of the width direction by the toner transport member 29 and is returned from the frame side return ports 62 to the inside of the toner reception chamber 45. As a result, the toner of the inside of the developing chamber 34 is returned to the toner reception chamber 45 and the amount of toner present inside the developing chamber 34 decreases.

When the predetermined time is measured by the timer 124 (S4: YES), the main motor 127 is stopped (i.e., turned off) (S5). Then, display to the effect that it is necessary to replace the toner cartridge 22 with a new toner cartridge is performed on the display panel 129 (S6).

In addition, display to the effect that toner runs out inside the toner reception chamber 45 may be performed and the display suggests that it is necessary to replace the toner cartridge 22 with a new toner cartridge, so that the display can be identified with the display to the effect that it is necessary to replace the toner cartridge 22 with the new toner cartridge.

As described above, the CPU 121 decides that a remaining state of toner in the toner cartridge 22 is an empty state before the amount of toner of the inside of the toner cartridge 22 for housing the toner becomes smaller than the amount of toner of the inside of the process part 33. At the time of forming an image, a certain amount of toner is housed inside the process part 33, so that it is decided that a state in which the certain amount or more of toner remains inside the toner cartridge 22 is the empty state, and a normal image forming action (i.e., an image forming action by user's intention) is inhibited. Thus, extreme deterioration of the toner of the insides of the process part 33 and the toner cartridge 22 can be prevented. Accordingly, when the toner cartridge 22 is replaced with a toner cartridge in which new toner is housed and the new toner is supplied from the toner cartridge 22 to the inside of the process part 33, the new toner can be prevented from being mixed with the extremely deteriorating toner. As a result, occurrence of an image forming defect resulting from mixture of the old and new toners can be prevented.

A spacing between the right edge of the right frame side return port 62 and the left edge of the left frame side return port 62 becomes longer than the width W of an image forming region in which a toner image is formed on a surface of the photoconductive drum 26. A spacing between the right edge of the cartridge side opening 49 made of the right inside return port 99 and outside return port 111 and the left edge of the cartridge side opening 49 made of the left inside return port 99 and outside return port 111 becomes longer than the width W of the image forming region in which the toner image is formed on the surface of the photoconductive drum 26. As a result, toner can be fluidized in the whole width of the image forming region in the inside of the process part 33 by supply of the toner from the inside of the toner cartridge 22 to the inside of the process part 33 and return of the toner from the inside of the process part 33 to the inside of the toner cartridge 22. As a result, a good toner image can be formed in the image forming region of the photoconductive drum 26.

When the CPU 121 decides that the remaining state is the empty state, driving of the agitator 46 disposed inside the toner cartridge 22 is stopped. Accordingly, supply of toner from the toner cartridge 22 to the process part 33 can be stopped. As a result, in a state in which a large amount of deteriorating toner remains inside the process part 33, the toner cartridge 22 can be prevented from being replaced with a toner cartridge in which new toner is housed.

When the CPU 121 decides that the remaining state is the empty state, supply of toner from the toner cartridge 22 to the process part 33 is stopped. In this state, the toner transport member 29 is driven, and the toner of the inside of the process part 33 is returned from a return port to the inside of the toner cartridge 22. Accordingly, the amount of toner remaining inside the process part 33 can be reduced. As a result, occurrence of an image forming defect resulting from mixture of the old and new toners can be prevented further.

Then, the display panel 129 displays on the display an indication that toner of the inside of the toner cartridge 22 runs out after the toner transport member 29 is driven for a predetermined time. Accordingly, in a state in which the amount of toner remaining inside the process part 33 reduces, the toner cartridge 22 is replaced with a toner cartridge in which new toner is housed, so that occurrence of an image forming defect resulting from mixture of the old and new toners can be prevented further.

6. Another Example of Empty Processing

Figure 12:
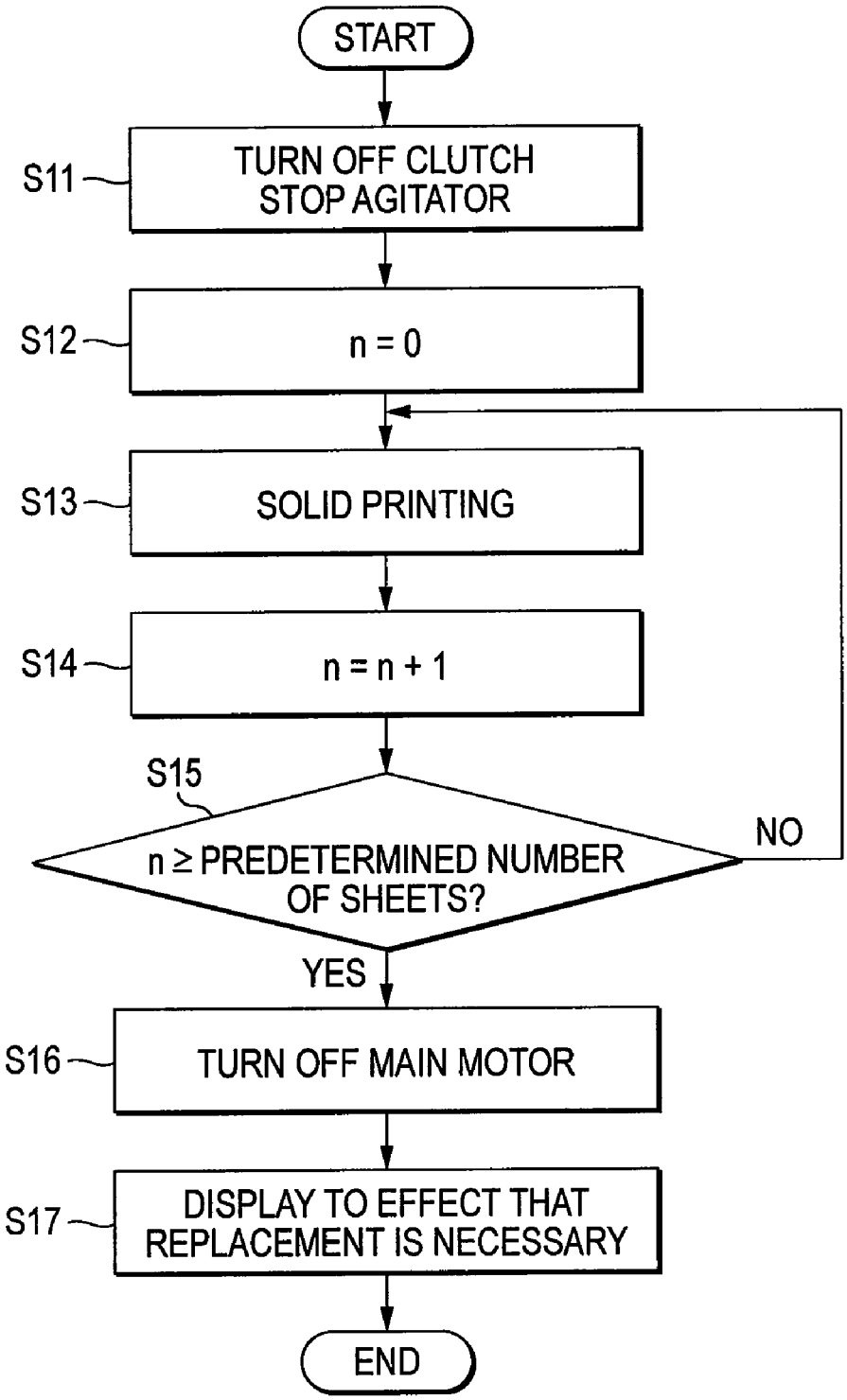
FIG. 12 is an exemplary flowchart showing modified example of the empty processing.

FIG. 12 is a flowchart describing another example of empty processing.

In the empty processing, the clutch 128 is first turned off. Accordingly, transmission of driving force from the main motor 127 to the agitator 46 is broken and the agitator 46 is stopped (S11).

Next, a value n of a counter set in the RAM 122 is set at zero (S12).

Thereafter, in a state of stopping the agitator 46, an image forming action is performed and one surface of the sheet 3 is painted out by a solid black color, the so-called solid printing is done (S13). The agitator 46 stops, so that toner is not supplied from the inside of the toner reception chamber 45 to the developing chamber 34. In contrast, the toner of the inside of the developing chamber 34 is consumed by the solid printing. As a result, the amount of toner present inside the developing chamber 34 decreases.

When the solid printing to one sheet 3 is done, the value n of the counter is updated to n+1 (S14).

When the value n of the counter reaches a predetermined number of sheets (S15: YES), that is, when the solid printing to the sheets 3 of the predetermined number of sheets is achieved, the main motor 127 is stopped (i.e., turned off) (S15). Then, display to the effect that it is necessary to replace the toner cartridge 22 with a new toner cartridge is performed on the display panel 129 (S16).

After supply of the toner from the toner cartridge 22 to the process part 33 is stopped, the solid printing is executed in order to consume the toner of the inside of the process part 33. Accordingly, the amount of toner remaining inside the process part 33 can be reduced. As a result, occurrence of an image forming defect resulting from mixture of old and new toners can be further prevented.

Then, the display panel 129 displays on the display an indication that the toner of the inside of the toner cartridge 22 runs out after the solid printing to the sheets 3 of the predetermined number of sheets is done. Accordingly, in a state in which the amount of toner remaining inside the process part 33 reduces, the toner cartridge 22 is replaced with a toner cartridge in which new toner is housed, so that occurrence of an image forming defect resulting from mixture of the old and new toners can be prevented further.

MODIFIED EXAMPLES

In the above-described aspects, the photoconductive drum 26, the electrification device 27, the transfer roller 28, the toner transport member 29, the supply roller 30, the developing roller 31 and the layer thickness regulating blade 32 are integrally held in the developing unit 13. However, the developing unit 13 may include a drum cartridge which is constructed attachably to and detachably from the body casing 2 and integrally holds the photoconductive drum 26, the electrification device 27 and the transfer roller 28, and a development cartridge which is constructed attachably to and detachably from the drum cartridge and integrally holds the toner transport member 29, the supply roller 30, the developing roller 31 and the layer thickness regulating blade 32.

Further, the photoconductive drum 26, the electrification device 27 and the transfer roller 28 may be mounted inside the body casing 2 rather than a form of the drum cartridge.

Still further, although aspects of the present inventive concept have been described in relation to a laser printer, the present inventive concept is not limited to a monochrome laser printer. Rather, the present inventive concept can also be applied to a color laser printer including a tandem type and an intermediate transfer type printer.

What is claimed is:

1. An image forming apparatus comprising:

a first cabinet;

a toner carrier that is supported in the first cabinet and carries suspension polymerization toner;

an image carrier that forms an electrostatic latent image and carries a toner image obtained by imaging the electrostatic latent image by supply of the suspension polymerization toner from the toner carrier;

a second cabinet that is disposed adjacently to the first cabinet in a horizontal direction orthogonal to a longitudinal direction of the toner carrier and houses the suspension polymerization toner;

a toner amount detector that detects an amount of suspension polymerization toner in the second cabinet; and an empty decision unit that decides whether or not a remaining state of the suspension polymerization toner in the second cabinet is an empty state based on a detection result of the toner amount detector, wherein an inside of the first cabinet is communicated to an inside of the second cabinet through a plurality of openings, the plurality of openings including at least a supply port for supplying the suspension polymerization toner from the second cabinet to the first cabinet and a return port for returning the suspension polymerization toner from the first cabinet to the second cabinet, and the plurality of openings being arranged in the longitudinal direction of the toner carrier, wherein a spacing between one outer edge of one opening provided in one end side in a longitudinal direction of the plurality of openings and another outer edge in a direction opposite to a longitudinal direction of another opening provided in another end side in the longitudinal direction of the plurality of openings has a width not less than a width of an image forming region where the toner image is formed in the image carrier, and wherein the empty decision unit decides that the remaining state of the suspension polymerization toner in the second cabinet is the empty state before the amount of suspension polymerization toner in the second cabinet becomes smaller than the amount of suspension polymerization toner in the first cabinet.

2. The image forming apparatus according to claim 1, further comprising:

a toner supply stop unit for stopping the supply of the suspension polymerization toner from the second cabinet to the first cabinet when the empty decision unit decides that the remaining state is the empty state.

3. The image forming apparatus according to claim 2, further comprising:

an agitator that is provided inside the second cabinet and feeds the suspension polymerization toner from the second cabinet toward the supply port while agitating the suspension polymerization toner, wherein the toner supply stop unit stops driving of the agitator.

4. The image forming apparatus according to claim 2, further comprising:

a toner transport member that is provided inside the first cabinet and transports the suspension polymerization toner supplied from the supply port in the longitudinal direction; and a toner return unit that returns the suspension polymerization toner from the first cabinet to the second cabinet thorough the return port by driving the toner transport member while stopping the supply of the suspension polymerization toner from the second cabinet to the first cabinet by the toner supply stop unit.

5. The image forming apparatus according to claim 4, further comprising:

an empty notification unit that indicates running out of the suspension polymerization toner in the second cabinet when the toner transport member is driven for a predetermined period of time after the empty decision unit decided that the remaining state is the empty state.

6. The image forming apparatus according to claim 2, further comprising:

a transfer unit that transfers a toner image carried on the image carrier to a record medium; and a toner consumption unit that consumes the suspension polymerization toner in the first cabinet by forming the toner image on the record medium by driving the toner carrier, the image carrier and the transfer unit while the toner supply stop unit stops the supply of the suspension polymerization toner from the second cabinet to the first cabinet.

7. The image forming apparatus according to claim 6, further comprising:

an empty notification unit that indicates running out of the suspension polymerization toner in the second cabinet when the toner image is formed on a predetermined number of record medium after the empty decision unit decided that the remaining state is the empty state.

* * * * *